US011504600B2

(12) United States Patent
Rocha

(10) Patent No.: US 11,504,600 B2
(45) Date of Patent: Nov. 22, 2022

(54) BACK BOARD

(71) Applicant: Jonathan Michael Rocha, Farmingville, NY (US)

(72) Inventor: Jonathan Michael Rocha, Farmingville, NY (US)

( * ) Notice: Subject to any disclaimer, the term of this patent is extended or adjusted under 35 U.S.C. 154(b) by 82 days.

(21) Appl. No.: 16/715,556

(22) Filed: Dec. 16, 2019

(65) Prior Publication Data

US 2020/0188764 A1 Jun. 18, 2020

Related U.S. Application Data

(60) Provisional application No. 62/780,734, filed on Dec. 17, 2018.

(51) Int. Cl.

| | |
|---|---|
| ***A63C 17/01*** | (2006.01) |
| ***A45F 5/02*** | (2006.01) |
| ***A45F 3/04*** | (2006.01) |

(52) U.S. Cl.

CPC ..... *A63C 17/01* (2013.01); *A45F 3/04* (2013.01); *A45F 5/02* (2013.01)

(58) Field of Classification Search

CPC ... A63C 17/01; A45F 3/04; A45F 5/02; A51F 1/00

See application file for complete search history.

(56) References Cited

U.S. PATENT DOCUMENTS 4,453,294 A * 6/1984 Morita ..... E05C 19/16 24/303
5,016,794 A 5/1991 Beagle, Jr.
5,369,899 A * 12/1994 Reeves ..... A44C 3/001 24/303
5,974,634 A * 11/1999 Eisenpresser ..... A44B 1/04 24/303
6,226,842 B1 * 5/2001 Wong ..... A41F 1/002 24/303
6,299,192 B1 * 10/2001 Bryce ..... A63C 9/086 280/613
7,220,158 B1 * 5/2007 Norris ..... B63B 32/45 441/74

(Continued)

FOREIGN PATENT DOCUMENTS

| | | |
|---|---|---|
| GB | 2 403 127 B | 9/2006 |
| WO | 2018129480 A1 | 7/2018 |

OTHER PUBLICATIONS

PCT Search Report, International Application No. PCT/US 19/66582, Applicant: Rocha, Jonathan Michael, dated Apr. 29, 2020, 6 pages.

(Continued)

*Primary Examiner* — Brian D Nash

(74) *Attorney, Agent, or Firm* — Saile Ackerman LLC; Stephen B. Ackerman; Rosemary L. S. Pike

(57) ABSTRACT

A back board and a method of holding a skateboard on a person's back are described. A back board can include a magnet infused skateboard or a magnet mounting assembly, attached to a skateboard. A back-mounted magnet infused holster, wherein, wearing the back-mounted magnet infused holster under or over clothing, the first magnet in or on the skateboard is configured so that together with the second magnet in the holster, the skateboard will hold to the back of ones back when placed.

11 Claims, 5 Drawing Sheets

(56) References Cited

U.S. PATENT DOCUMENTS 7,690,542 B1 * 4/2010 Silvera ..... A45F 5/021 224/579
8,469,569 B1 * 6/2013 Tunnicliffe ..... A63C 17/015 362/545
8,540,197 B1 9/2013 Krol, II
8,615,853 B2 12/2013 Rathbun
8,936,222 B1 * 1/2015 Bastian ..... H04B 1/3877 248/206.5
8,998,052 B1 4/2015 Mitchell
9,131,739 B1 * 9/2015 Sjoquist ..... A41F 1/002
9,268,201 B1 * 2/2016 Montgomery ..... G03B 29/00
9,685,265 B2 6/2017 Stutz
9,717,293 B2 * 8/2017 Lim ..... A41F 1/002
9,746,299 B1 * 8/2017 Davis ..... F42B 39/02
10,946,939 B1 * 3/2021 Montague ..... B63B 1/242
2003/0075890 A1 4/2003 Jascobs
2003/0094788 A1 * 5/2003 Jacobs ..... A63C 17/262 280/612
2003/0224676 A1 * 12/2003 Takahashi ..... B63B 32/47 441/74
2004/0104551 A1 * 6/2004 Jacobs ..... A63C 17/262 280/87.042
2004/0238585 A1 12/2004 Scarano
2005/0082323 A1 * 4/2005 O'Hair ..... B25H 3/00 224/219
2006/0197311 A1 * 9/2006 Flaig ..... B63B 32/47 280/611
2007/0080518 A1 * 4/2007 Carvajal ..... A63C 10/12 280/611
2008/0150257 A1 * 6/2008 Flaig ..... A63C 9/0802 280/612
2009/0193629 A1 * 8/2009 Suenaga ..... G09F 7/04 24/303
2009/0212082 A1 8/2009 Bautista et al.
2009/0289090 A1 * 11/2009 Fullerton ..... A45F 5/02 224/183
2009/0314813 A1 12/2009 Woolery
2010/0025967 A1 * 2/2010 Flaig ..... A63C 10/12 280/612
2010/0061711 A1 * 3/2010 Woodman ..... G03B 29/00 396/428
2010/0237599 A1 * 9/2010 Bianchi ..... A43B 1/0054 280/841
2013/0214701 A1 * 8/2013 Forgey, II ..... H05B 47/155 315/307
2014/0042728 A1 * 2/2014 Noyes ..... A63C 10/18 280/612
2014/0182088 A1 * 7/2014 Roberts ..... H01F 7/0242 24/303
2015/0216276 A1 * 8/2015 Stratton ..... A45F 5/02 224/183
2015/0235572 A1 8/2015 Sheerer et al.
2015/0289629 A1 * 10/2015 Nakamura ..... A45C 13/08 36/136
2016/0242534 A1 * 8/2016 Mathieu ..... A41D 13/0012
2016/0296825 A1 * 10/2016 Wolniansky ..... B63B 32/47
2016/0339326 A1 * 11/2016 Postaire ..... A63C 5/03
2017/0007046 A1 * 1/2017 Wiseman ..... A47G 1/17
2017/0120401 A1 * 5/2017 Fullerton ..... B23P 15/001
2017/0251791 A1 9/2017 Ball
2018/0325247 A1 * 11/2018 Vlassis ..... A45C 13/1069
2019/0226244 A1 * 7/2019 Kinnich ..... A63C 17/0013
2019/0246724 A1 * 8/2019 Adams ..... A41F 1/002
2020/0367627 A1 * 11/2020 McCarthy ..... A45C 13/02
2021/0093028 A1 * 4/2021 Grinnell ..... F16M 13/04
2021/0129947 A1 * 5/2021 Reifsnyder ..... B63B 32/70
2021/0145155 A1 * 5/2021 Coats ..... A41D 27/20

OTHER PUBLICATIONS

PCT Written Opinion, International Application No. PCT/US 19/66582, Applicant: Rocha, Jonathan Michael, dated Apr. 29, 2020, 8 pages.

* cited by examiner

BACK BOARD

BACK BOARD

This application claims benefit of U.S. Provisional application Ser. No. 62/780,734, filed on Dec. 17, 2018, and herein incorporated by reference in its entirety.

TECHNICAL FIELD

The disclosure relates to skateboarding gear, and more particularly, to a back-mounted skateboard holder.

BACKGROUND

Many people enjoy skateboarding as a source of transportation. However, once at the destination, holding a skateboard in one's hand may not be an option. Using a backpack may be cumbersome, aesthetically unpleasing, or not allowed. Thus, there may be a need to provide a way to mount a Skateboard to one's back when not riding it.

Some implementations were conceived in light of the above mentioned needs, among other things.

SUMMARY

A principal object of the present disclosure is to provide a device for mounting a skateboard onto one's back.

Another object of the present disclosure is to provide a method for mounting a skateboard onto one's back.

In accordance with the objects of the disclosure, a back board is provided comprising a magnet infused skateboard or a magnet mounting assembly connected to a skateboard. A back-mounted magnet infused holster wherein the first magnet in or on the skateboard is configured so that together with the second magnet in the holster, the skateboard will hold to the back-mounted magnet infused holster.

Also in accordance with the objects of the disclosure a method for using a back board to hold a skateboard to a user's back is achieved. A back board is provided comprising a magnet infused skateboard or a magnet mounting assembly connected to a skateboard. A back-mounted magnet infused holster wherein, wearing the back-mounted magnet holster under or over clothing, the first magnet in or on the skateboard is configured so that together with the second magnet in the holster, the skateboard will hold to the back of ones body when placed.

BRIEF DESCRIPTION OF THE DRAWINGS

In the accompanying drawings forming a material part of this description, there is shown.

DETAILED DESCRIPTION

The present disclosure describes a back board including a magnet infused skateboard or a mounting magnet assembly and corresponding back-mounted magnet infused holster. Also described are methods for wearing a skateboard on one's back. The method can include providing a back board and wearing the back-mounted magnet infused harness under or above one's clothing. The method can also include using a magnet infused-skateboard or a mounting magnet assembly connected to a skateboard. The method can further include placing the skateboard on one's back to be held in place with back board.

Figure 1:
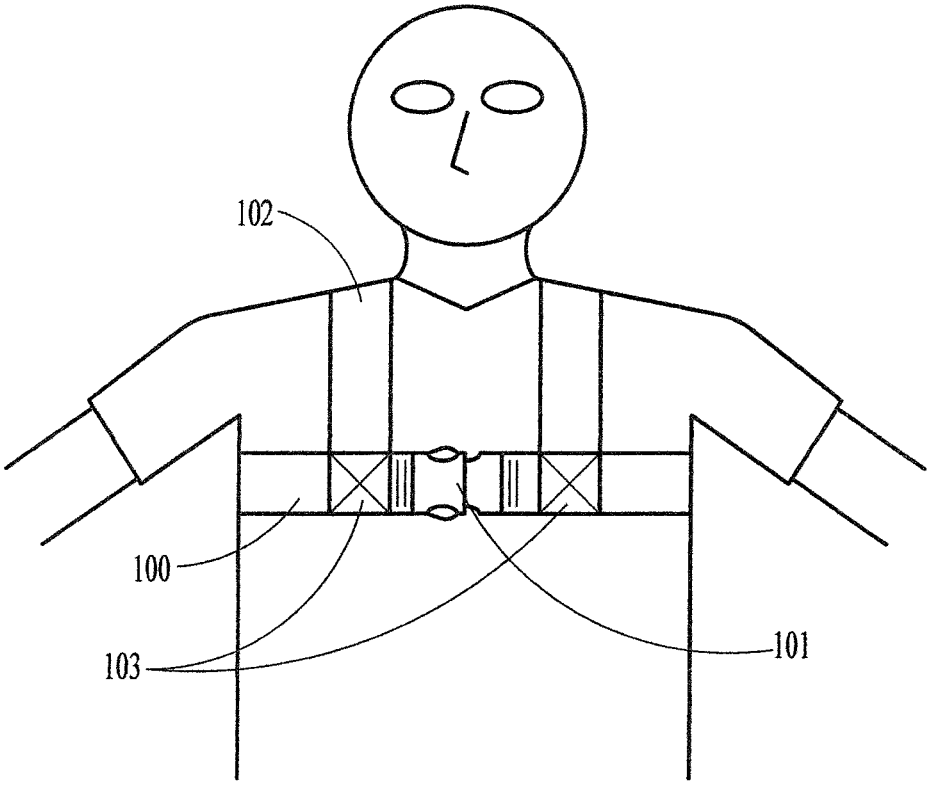
FIG. 1 is a front view of a person wearing the back-mounted magnet infused holster in a preferred embodiment of the present disclosure.

FIG. 1 is a front view of a person wearing a back-mounted magnet infused holster. It includes a front buckle 101, which may be equipped with an optional camera mount (not shown). The webbing is composed but not limited to variations of polyester, 100/102. Webbing is held together with nylon thread for strength at connecting points, 103.

Figure 2:
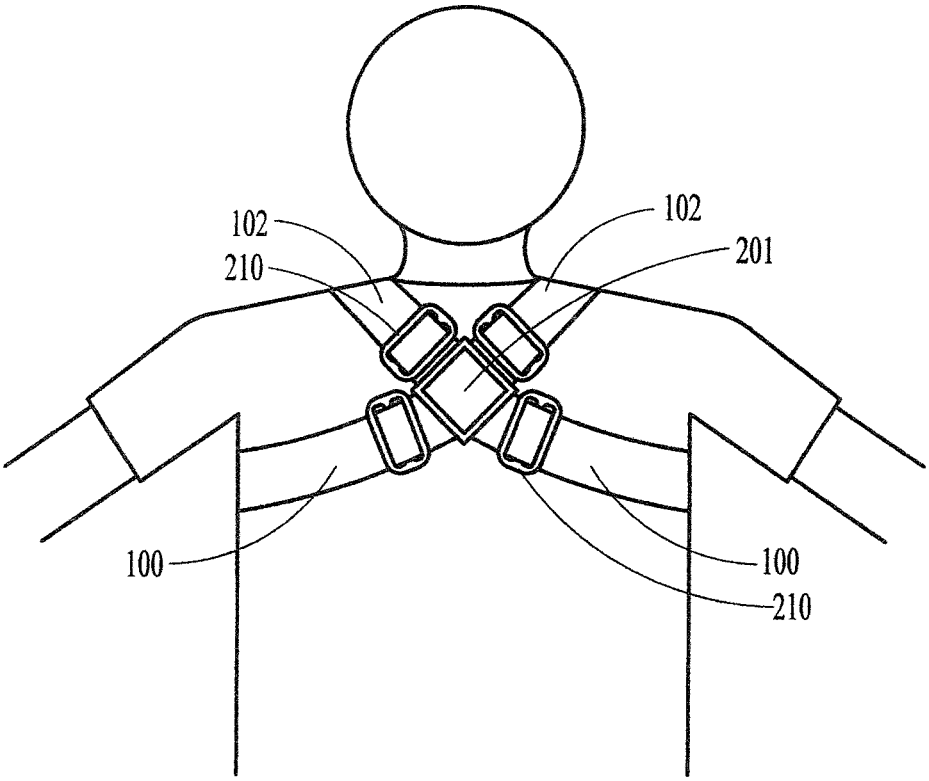
FIG. 2 is a back view of a person wearing the back-mounted magnet infused holster in a preferred embodiment of the present disclosure.

FIG. 2 is a back view of a person wearing the back-mounted magnet infused holster. The center housing, 201, holds an infused magnet. The tri-bar adjustable sliders, 210, allows both the top webbing, 102, and bottom webbing, 100, to be adjustable; assuring a comfortable fit.

Figure 3A:
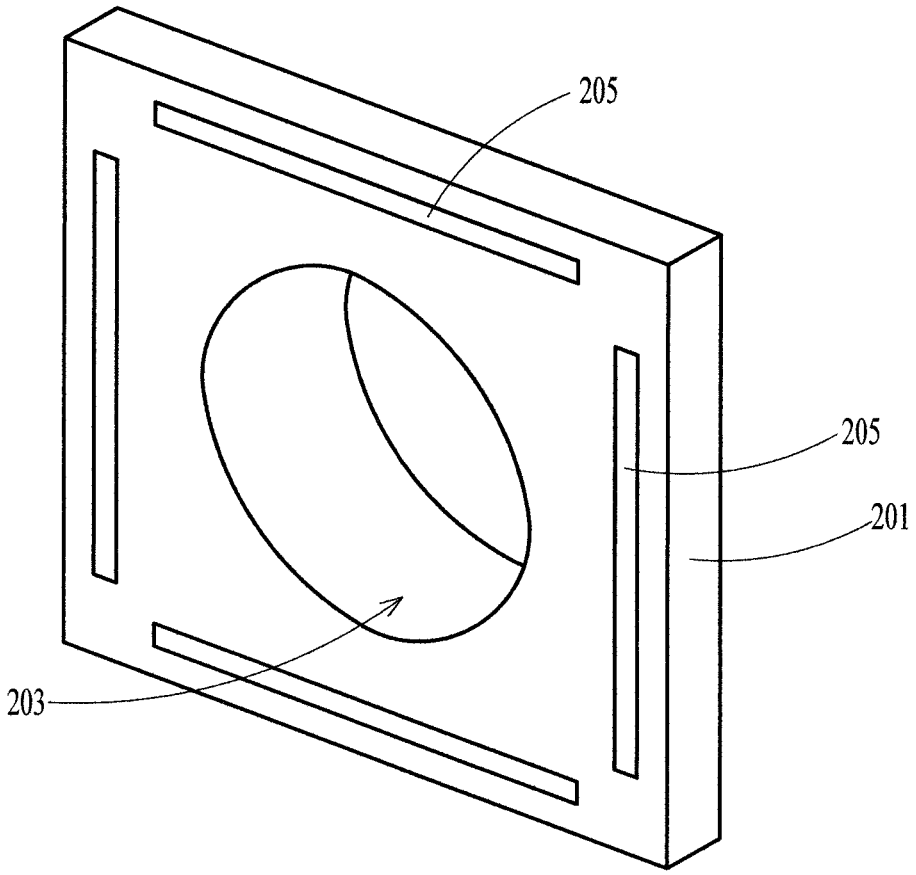
FIG. 3A is an enlarged perspective view of the housing that holds the infused magnet in the center of the back-mounted magnet infused holster in a preferred embodiment of the present disclosure.
Figure 3B:
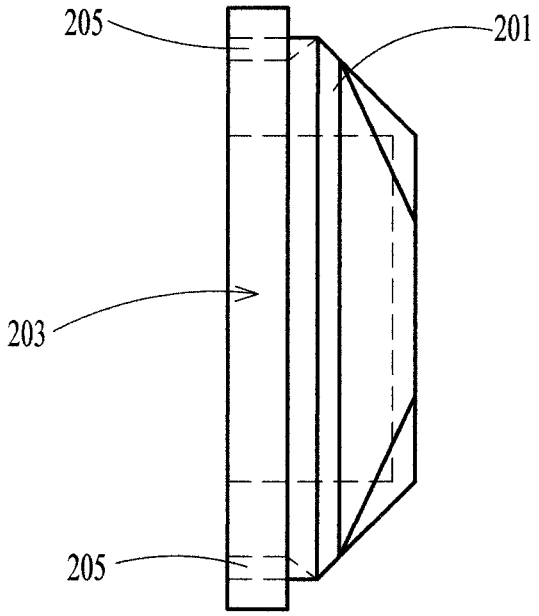
FIG. 3B is an enlarged side view of the housing that holds the infused magnet in the center of the back-mounted magnet infused holster in a preferred embodiment of the present disclosure.

FIGS. 3A and 3B illustrates an enlarged perspective view and side view of the center housing, 201, that holds the infused magnet. A preferred 1.25" [diameter]×0.5" [thick] cylinder, neodymium magnet infuses into cavity, 203, with a flexible epoxy adhesive. All webbing is able to connect and adjust by passing through the housings connecting slots, 205.

Figure 4:
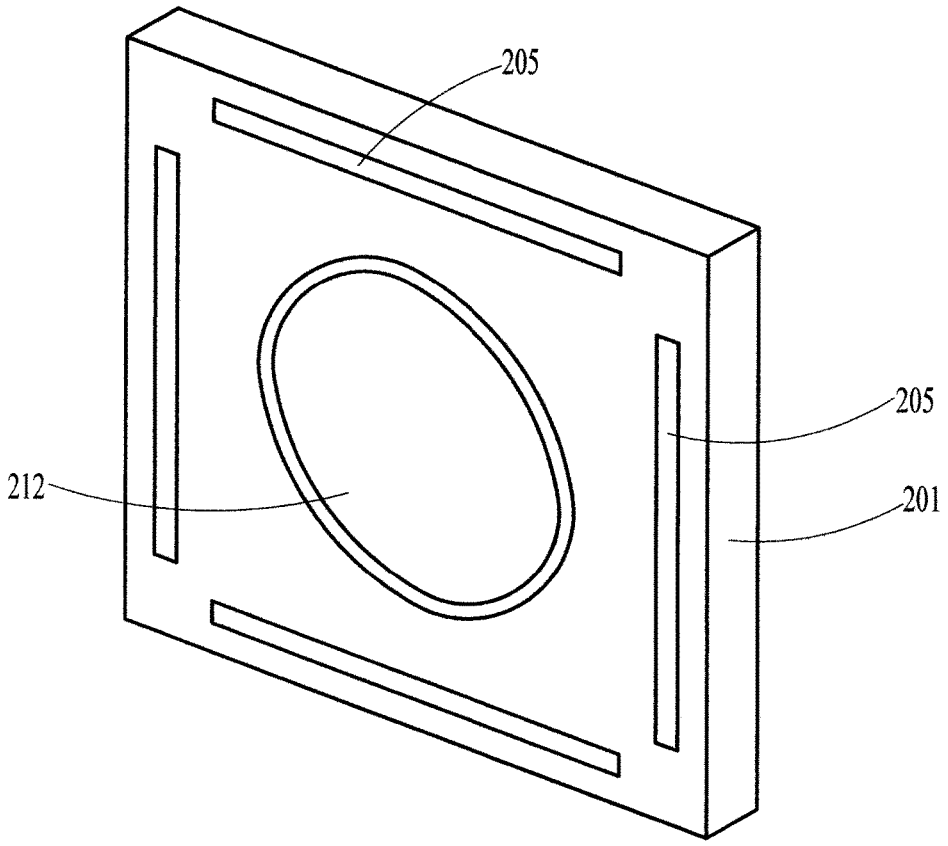
FIG. 4 is an enlarged perspective view of the housing that holds the infused magnet in the center of the back-mounted magnet infused holster, with magnet installed, in a preferred embodiment of the present disclosure.

FIG. 4 illustrates an enlarged perspective view of the center housing, 201, that holds the infused magnet, 212. A 1.25" [diameter]×0.5" [thick] cylinder, neodymium magnet, 212, in its preferred embodiment is shown in cavity, 203; as seen in FIG. 3A.

Figure 5A:
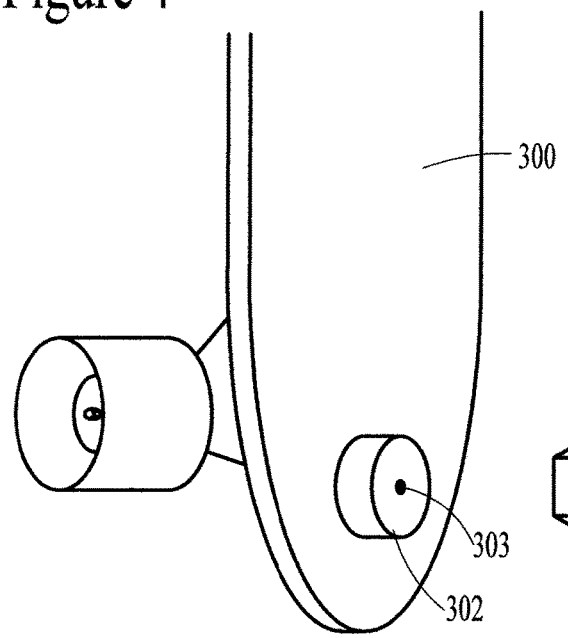
FIGS. 5A and 5B illustrate a magnet mounting assembly both installed on a skateboard and uninstalled, respectively, in a first preferred embodiment of the present disclosure.
Figure 5B:
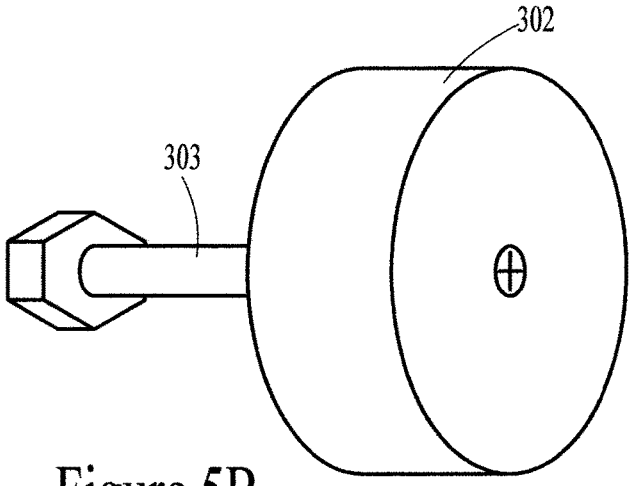

In a first preferred embodiment of the present disclosure, a magnet mounting assembly is connected onto a skateboard, as illustrated in FIGS. 5A and 5B.

FIG. 5A illustrates a preferred, 1.25" [diameter]×#10 screw hole×0.35" [thick] cylinder, neodymium magnet, 302. This magnet is preferably coated in plastic and mounted on traditional skateboard, 300.

FIG. 5B illustrates magnet, 302, mounted by a #10 size screw/nut preferably 1.5" long, 303. #10 screw/nut are the standard hardware for most skateboards. The diameter of the first and second neodymium magnets in back board work best if they are the same diameter; this maximizes the magnetic force.

Figure 6A:
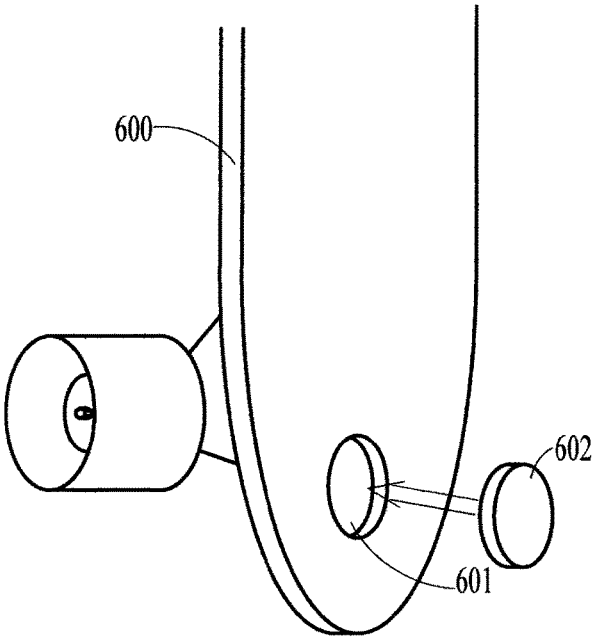
FIGS. 6A and 6B illustrate a magnet infused within the skateboard deck in a second preferred embodiment of the present disclosure.
Figure 6B:
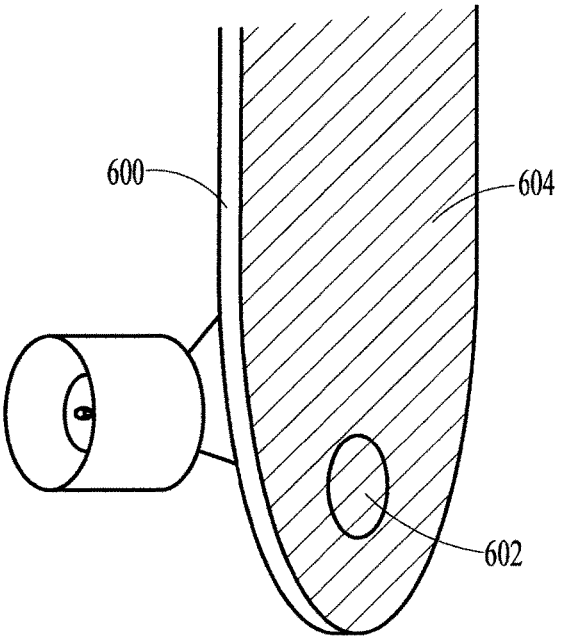

In a second preferred embodiment of the present disclosure, a corresponding magnet is infused within the deck of a skateboard, as illustrated in FIGS. 6A and 6B.

FIG. 6A illustrates a skateboard, preferably a wooden skateboard typically about ⅜" thick, 600. A plunge router may be used to make a cavity in the skateboard deck, 601. The cavity, 601, is preferably 1.25" diameter by 0.25" deep. A neodymium magnet, 1.25" [diameter]×0.25" [thick], 602, is then placed into cavity, 601, so that the magnet in the cavity is flush with the top surface of the skateboard, 600. The magnet, 602, is infused into the cavity with a flexible epoxy adhesive such as, E6000-brand [Eclectic Products, Eugene, Oreg.], adhesive and then covered and hidden by skateboard griptape, 604, as shown in FIG. 6B.

Figure 7:
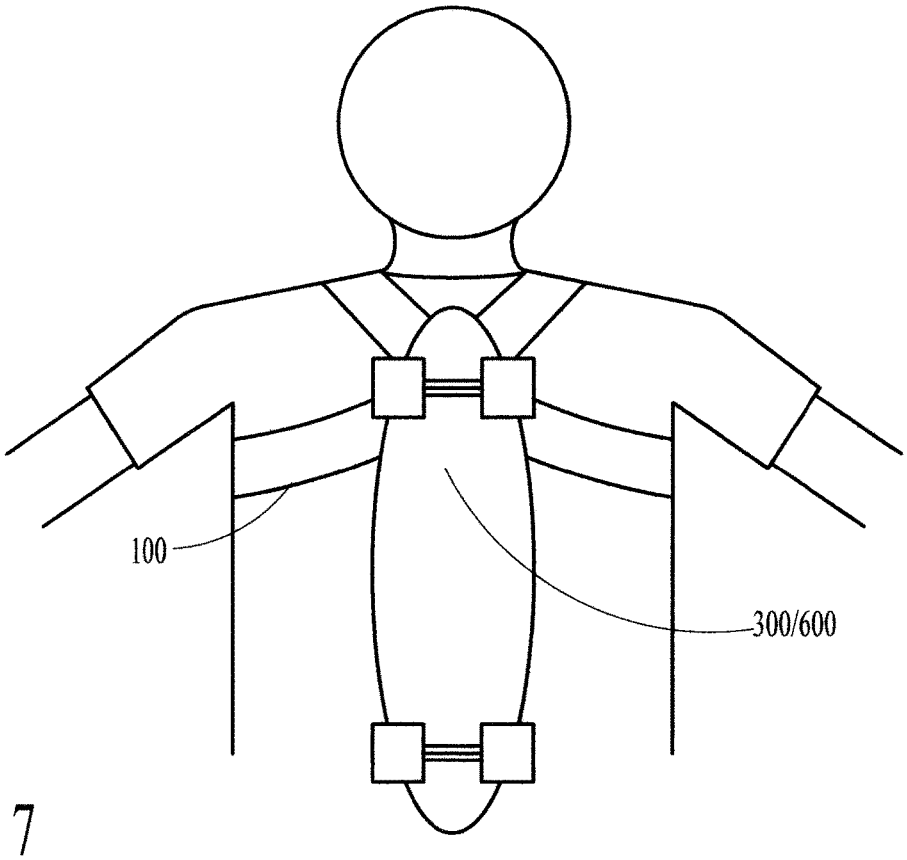
FIG. 7 is a skateboard on a persons back being held in place with back board in a preferred embodiment of the present disclosure.

FIG. 7 illustrates a skateboard, 300, of the first embodiment or 600 of the second embodiment mounted onto a person's back and being held in place by joining first said neodymium magnets, either 302 or 602 on skateboard 300 or 600 and second said neodymium magnet infused within, 201, on the back-mounted magnet infused holster as seen in FIG. 2. Alternatively, other objects which are normally awkward to carry could be infused with a magnet or have a magnet attached thereto and could be magnetically held by said back-mounted magnet infused holster. Objects include, but are not limited to umbrellas, guitars, lawn chairs and handbags.

Figure 8:
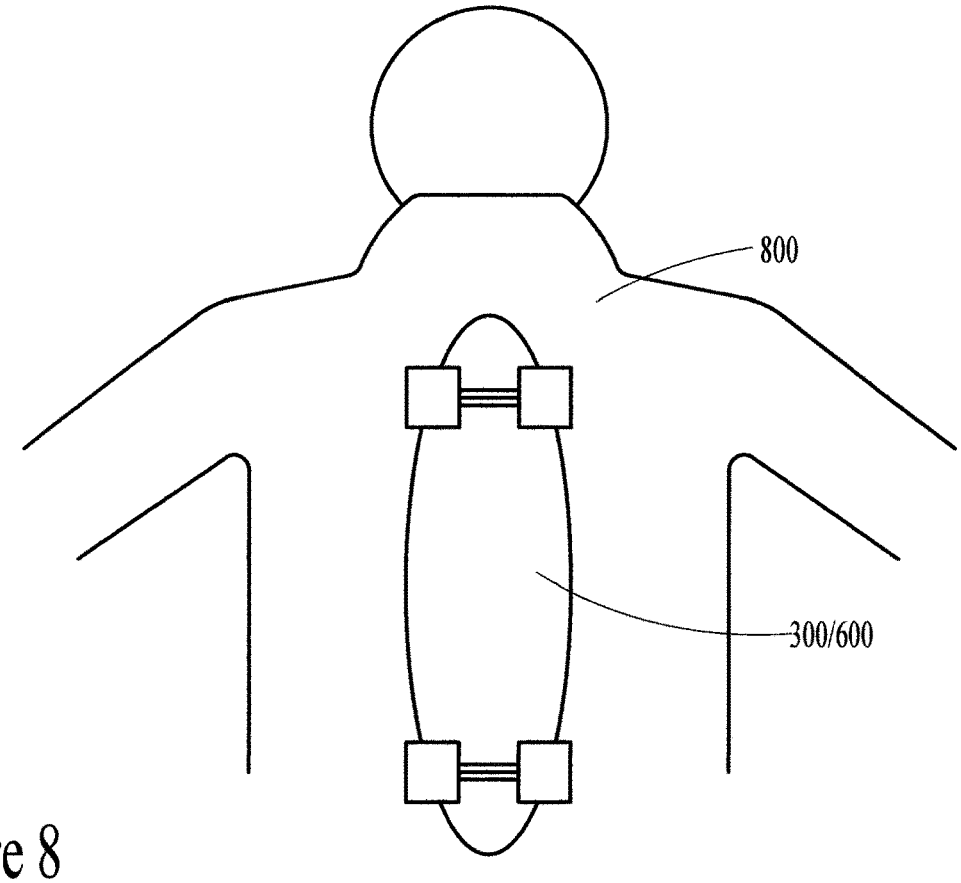
FIG. 8 is the back-mounted magnet infused harness worn under a jacket with a skateboard on a person's back being held in place with the back board in a preferred embodiment of the present disclosure.

FIG. 8 The neodymium magnets are strong enough to hold through an intervening clothing article such as the jacket, 800, shown in FIG. 8. In this embodiment, the back-mounted magnet infused holster is worn under a jacket, 800. The skateboard 300 or 600 is being held in place by the joined magnets 302 or 602 on the skateboard 300 or 600 and the back-mounted neodymium magnet infused inside the housing, center of the holster, 201.

Figure 9:
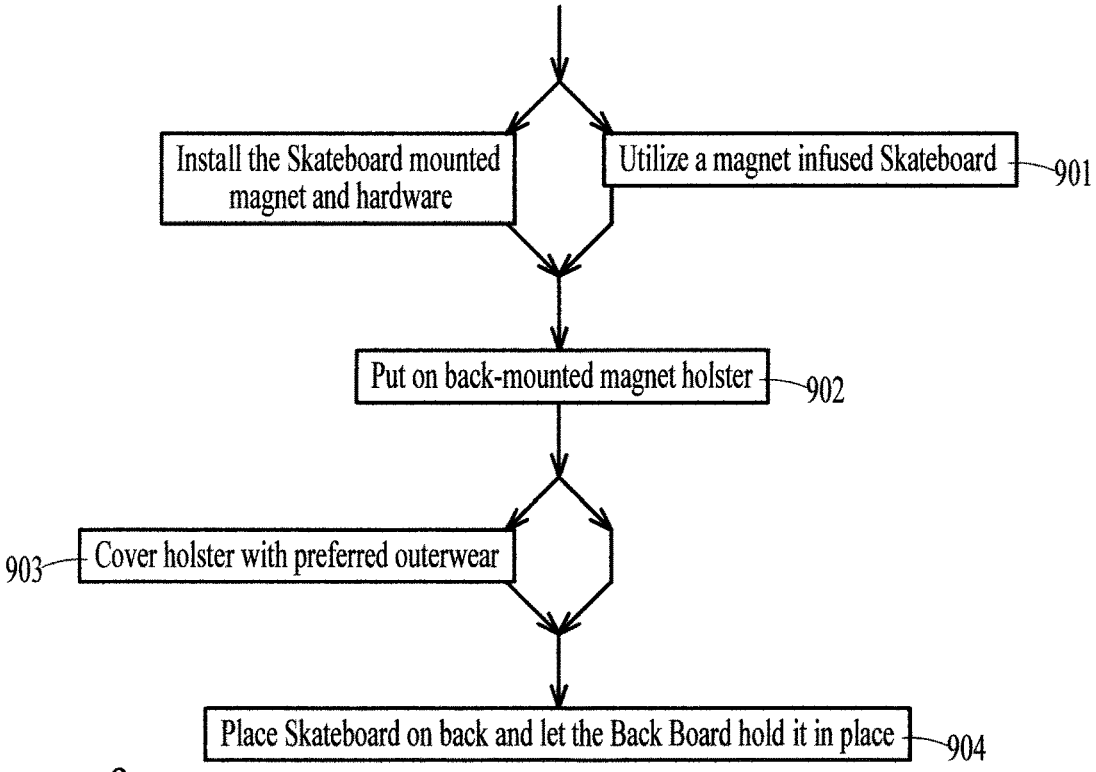
FIG. 9 is a flowchart of an example method of using the back board in a preferred embodiment of the present disclosure.

FIG. 9 is a flow chart of an example method of using the back board of the present disclosure. The method begins at, 901, where a user installs the skateboard, 300, with magnet mounting assembly, 302, 303 and 304 as seen in FIG. 5A. Alternatively, a user utilizes a magnet-infused skateboard as seen in FIG. 6B. At 902, the user puts on the back-mounted magnet infused holster as seen in FIG. 1. At 903, optionally, the user may cover the holster with preferred outerwear. At 904, place the skateboard on the user's back and let the back board hold it in place; as seen in FIGS. 7 and 8.

It is, therefore, apparent that there is provided, in accordance with the various embodiments disclosed herein, the back board and method of securing a skateboard to one's back.

While the disclosed subject matter has been described in conjunction with a number of embodiments, it is evident that many alternatives, modifications and variations would be, or are, apparent to those of ordinary skill in the applicable arts. Accordingly, applicant intends to embrace all such alternatives, modifications, equivalents and variations that are within the spirit and scope of the disclosed subject matter and the appended claims.

What is claimed is:

1. A back board, comprising:

a back-mounted magnet infused holster; wherein a first magnet is infused in said back-mounted magnet infused holster and wherein a second magnet in or on a skateboard is configured so that together with the first magnet in the back-mounted magnet infused holster, the skateboard will hold to the back-mounted magnet infused holster.

2. The back board according to claim 1 wherein said back-mounted magnet infused holster further comprises polyester webbing connected to said magnet infused holster.

3. The back board according to claim 2 wherein said polyester webbing is adjustably connected to said back-mounted magnet infused holster, for comfortably holding said magnet infused housing holster to a user's back.

4. The back board according to claim 3 further comprising tri-bar adjustable webbing sliders connected to said polyester webbing near said magnet infused holster.

5. The back board according to claim 2 wherein said polyester webbing is held together with nylon thread.

6. The back board according to claim 1 wherein said first and second magnets comprise neodymium magnets.

7. The back board according to claim 1 wherein said first and second magnets have a same diameter.

8. A method of using a back board, the method comprising:

providing a back board, comprising:

a back-mounted magnet infused holster wherein a first magnet is infused in said back-mounted magnet infused holster;

providing a second magnet in or on a skateboard; and placing said skateboard on a user's back wherein said first magnet and second magnet together hold said skateboards on said user's back.

9. The method according to claim 8 wherein said second magnet is in a magnet mounting assembly on said skateboard and wherein said magnet mounting assembly is attached to said skateboard using a standard #10, 1.5" long skateboard screw and nut.

10. The method according to claim 8 wherein said second magnet in or on said skateboard is configured so that together with said first magnet housed in the back-mounted magnet infused holster, the skateboard will hold onto said user's back when said user is wearing said back-mounted magnet infused holster above or underneath formal clothing.

11. The method according to claim 8 wherein said second magnet is infused within a cavity in a surface of said skateboard using a flexible epoxy adhesive and wherein said second magnet is flush with a top surface of said skateboard.

* * * * *